US009384641B2

(12) United States Patent
Zhevelev

(10) Patent No.: US 9,384,641 B2
(45) Date of Patent: Jul. 5, 2016

(54) GLASS BREAKAGE DETECTION SYSTEM AND METHOD

(71) Applicant: Tyco Fire & Security GmbH, Neuhausen am Rheinfall (CH)

(72) Inventor: Boris Zhevelev, Rishon Le Zion (IL)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 2 days.

(21) Appl. No.: 14/501,398

(22) Filed: Sep. 30, 2014

(65) Prior Publication Data

US 2016/0093177 A1 Mar. 31, 2016

(51) Int. Cl.

| | |
|---|---|
| ***G08B 13/18*** | (2006.01) |
| ***G08B 13/04*** | (2006.01) |
| ***H04R 29/00*** | (2006.01) |

(52) U.S. Cl.

CPC ..... *G08B 13/04* (2013.01); *H04R 29/00* (2013.01)

(58) Field of Classification Search

CPC .... G08B 25/009; G08B 25/10; G08B 19/005; G08B 29/14; G08B 13/248; G08B 25/002; G08B 25/08; G08B 29/06; G08B 25/008; G08B 13/04; G08B 25/004; G08B 13/1672; G08B 29/183; G08B 13/19695

USPC ..... 340/552, 522, 511, 426.23, 340/541–693.12, 426.27, 531

See application file for complete search history.

(56) References Cited

U.S. PATENT DOCUMENTS

| | | | | |
|---|---|---|---|---|
| 3,863,250 | A | 1/1975 | McCluskey, Jr. | |
| 4,134,109 | A | 1/1979 | McCormick et al. | |
| 4,668,941 | A | 5/1987 | Davenport et al. | |
| 4,837,558 | A | 6/1989 | Abel et al. | |
| 4,853,677 | A | 8/1989 | Yarbrough et al. | |
| 5,510,767 | A * | 4/1996 | Smith | G08B 13/04 340/550 |
| 5,515,029 | A | 5/1996 | Zhevelev et al. | |
| 5,810,765 | A * | 9/1998 | Oda | A61M 1/0058 604/22 |
| 5,831,528 | A * | 11/1998 | Cecic | G08B 13/04 340/522 |
| 6,493,687 | B1 | 12/2002 | Wu et al. | |
| 6,538,570 | B1 | 3/2003 | Smith | |
| 7,812,855 | B2 * | 10/2010 | Babich | G08B 13/04 340/426.23 |
| 8,199,608 | B2 * | 6/2012 | Piel | G08B 13/04 367/13 |
| 2005/0264413 | A1 * | 12/2005 | Eskildsen | G08B 13/04 340/522 |

FOREIGN PATENT DOCUMENTS

| | | |
|---|---|---|
| IL | 107834 | 8/1997 |

* cited by examiner

*Primary Examiner* — Daniel Previl
(74) *Attorney, Agent, or Firm* — HoustonHogle, LLP

(57) ABSTRACT

A method for detecting a glass breakage event, the method including, responsive to receiving a plurality of acoustic event indications associated with an acoustic event, ascertaining whether the plurality of acoustic event indications together indicate a random nature of at least part of the acoustic event, thereby ascertaining that the acoustic event corresponds to a glass breakage event.

9 Claims, 6 Drawing Sheets

GLASS BREAKAGE DETECTION SYSTEM AND METHOD

FIELD OF THE INVENTION

The present invention relates generally to glass breakage detection systems and methods.

BACKGROUND OF THE INVENTION

Glass breakage detection systems are well known in the art. However, currently available glass breakage systems typically lack the ability to reliably differentiate between actual glass breakage events and other acoustic events which may generate similar acoustic events.

SUMMARY OF THE INVENTION

The present invention seeks to provide a system and method for detecting glass breakage events.

There is thus provided in accordance with a preferred embodiment of the present invention a method for detecting a glass breakage event, the method including, responsive to receiving a plurality of acoustic event indications associated with an acoustic event, ascertaining whether the plurality of acoustic event indications together indicate a random nature of at least part of the acoustic event, thereby ascertaining that the acoustic event corresponds to a glass breakage event.

Preferably, each acoustic event indication of the plurality of acoustic event indications includes at least an amplitude of a sound wave associated with the acoustic event indication, a frequency of a sound wave associated with the acoustic event indication, and a point in time at which the acoustic event indication occurred. Preferably, each of the plurality of acoustic event indications is associated with one of a sound wave corresponding to the smashing of a glass pane, a sound wave corresponding to the cracking of a glass pane, and a sound wave corresponding to the falling of glass debris.

Preferably, the random nature of at least part of the acoustic event corresponds to a random nature of at least one of the sound wave corresponding to the falling of glass debris and the sound wave corresponding to the cracking of a glass pane. Preferably, the ascertaining whether the plurality of acoustic event indications together indicate a random nature of at least part of the acoustic event includes transforming the plurality of acoustic event indications into a virtual surface function. Additionally, the ascertaining whether the plurality of acoustic event indications together indicate a random nature of at least part of the acoustic event also includes ascertaining a randomness of the virtual surface function.

There is also provided in accordance with another preferred embodiment of the present invention a glass breakage detection system, the system including random acoustic event analyzing functionality operable for ascertaining, responsive to receiving a plurality of acoustic event indications associated with an acoustic event, whether the plurality of acoustic event indications together indicate a random nature of at least part of the acoustic event, thereby ascertaining that the acoustic event corresponds to a glass breakage event.

Preferably, the system also includes acoustic event indication receiving functionality operable for receiving the plurality of acoustic event indications associated with the acoustic event.

Preferably, each acoustic event indication of the plurality of acoustic event indications includes at least an amplitude of a sound wave associated with the acoustic event indication, a frequency of a sound wave associated with the acoustic event indication, and a point in time at which the acoustic event indication occurred. Preferably, each of the plurality of acoustic event indications is associated with one of a sound wave corresponding to the smashing of a glass pane, a sound wave corresponding to the cracking of a glass pane, and a sound wave corresponding to the falling of glass debris.

Preferably, the random nature of at least part of the acoustic event corresponds to a random nature of at least one of the sound wave corresponding to the falling of glass debris and the sound wave corresponding to the cracking of a glass pane. Preferably, the ascertaining whether the plurality of acoustic event indications together indicate a random nature of at least part of the acoustic event includes transforming the plurality of acoustic event indications into a virtual surface function. Additionally, the ascertaining whether the plurality of acoustic event indications together indicate a random nature of at least part of the acoustic event also includes ascertaining a randomness of the virtual surface function.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
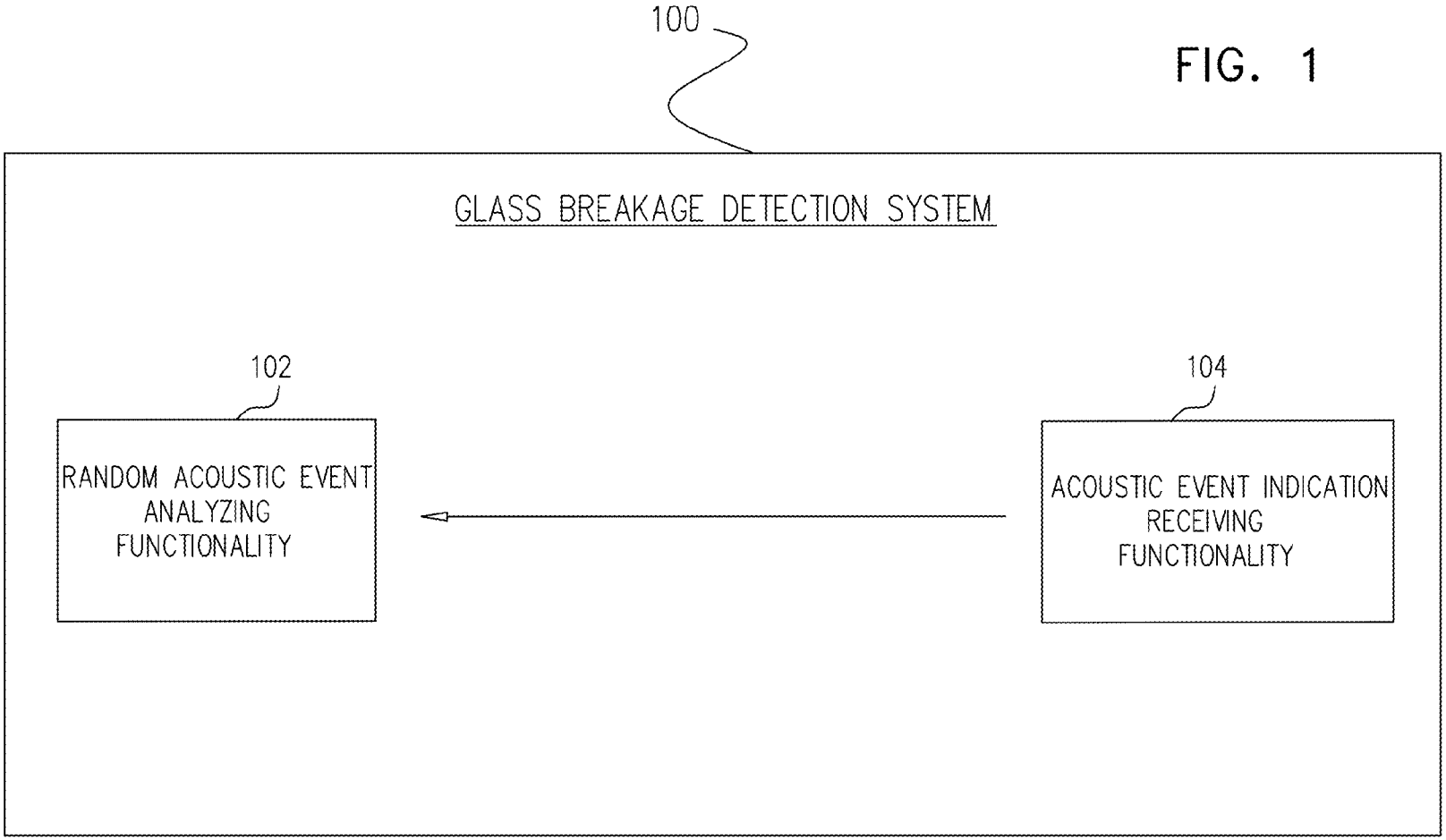
FIG. 1 is a simplified block diagram illustration of a glass breakage detection system constructed and operative in accordance with a preferred embodiment of the present invention.
Figure 2A:
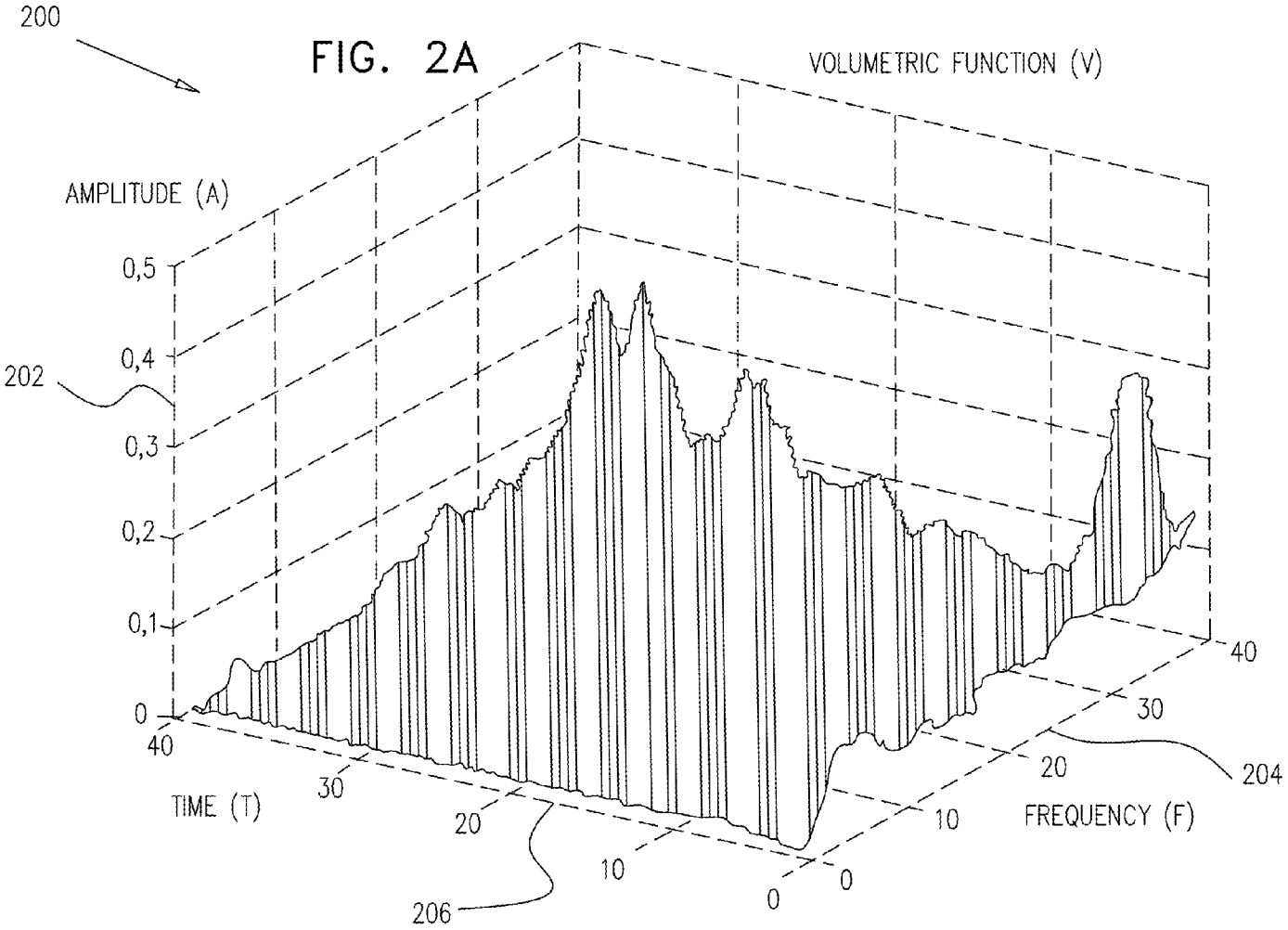
FIG. 2A is a simplified graphic representation of a plurality of acoustic event indications received and processed by the glass breakage detection system of FIG. 1 to detect a glass breakage event.

Reference is now made to FIG. 1, which is a simplified block diagram illustration of a glass breakage detection system constructed and operative in accordance with a preferred embodiment of the present invention, and to FIG. 2A, which is a simplified graphic representation of a plurality of acoustic event indications received and processed by the glass breakage detection system of FIG. 1 to detect a glass breakage event.

The glass breakage detection system 100 of FIG. 1 preferably includes random acoustic event analyzing functionality 102 operable for ascertaining, responsive to receiving a plurality of acoustic event indications associated with an acoustic event, whether the plurality of acoustic event indications together indicate a random nature of at least part of the acoustic event, thereby ascertaining that the acoustic event corresponds to a glass breakage event.

The glass breakage detection system 100 of the present invention is operative to differentiate between detection of actual breakage of glass, such as a window pane of a window in a premises, which may be indicative of an intrusion into the premises, and other similar noises which are typically not indicative of actual breakage of glass.

The glass breakage detection system of FIG. 1 also preferably includes acoustic event indication receiving functionality 104 operable for receiving the plurality of acoustic event indications associated with the acoustic event. It is appreciated that acoustic event indication receiving functionality 104 may comprise sound detection capabilities, such as a microphone. Alternatively, acoustic event indication receiving functionality 104 may be operable to receive acoustic event indications from a system which is external to glass breakage detection system 100.

It is appreciated that glass breakage detection system 100 may be embodied, for example, on a suitable computing device which preferably includes a processor and a memory.

As shown in FIG. 2A, each acoustic event indication of the plurality of acoustic event indications received by event indication receiving functionality 104 of system 100 is represented on a graph 200 and preferably includes:

an amplitude of a sound wave associated with the acoustic event indication plotted on axis 202 of graph 200;

a frequency of a sound wave associated with the acoustic event indication plotted on axis 204 of graph 200; and a point in time at which the acoustic event indication occurred plotted on axis 206 of graph 200.

It is appreciated that each of the plurality of acoustic event indications represented on graph 200 is associated with one of a sound wave corresponding to the smashing of a glass pane, a sound wave corresponding to the cracking of a glass pane, and a sound wave corresponding to the falling of glass debris and/or glass pane cracking.

It is a particular feature of the present invention that random acoustic event analyzing functionality 102, responsive to receiving the plurality of acoustic event indications which are represented on graph 200 and which are associated with an acoustic event, is operable to ascertain whether the plurality of acoustic event indications represented on graph 200 together indicate a random nature of at least part of the acoustic event, and to thereby ascertain that the acoustic event corresponds to a glass breakage event.

It is appreciated that the random nature of at least part of an acoustic event typically corresponds to the random nature of a sound wave corresponding to the falling of glass debris and/or glass pane cracking. It is further appreciated that the random nature of the sound wave corresponding to the falling of glass debris and/or glass pane cracking is typically independent of acoustics of the surroundings such as, for example, room acoustics, the type of object used to break the glass and the presence of other objects in the immediate surroundings. Therefore, the random nature of the sound wave corresponding to the falling of glass debris and/or glass pane cracking is a reliable indication of glass breakage.

Figure 2B:
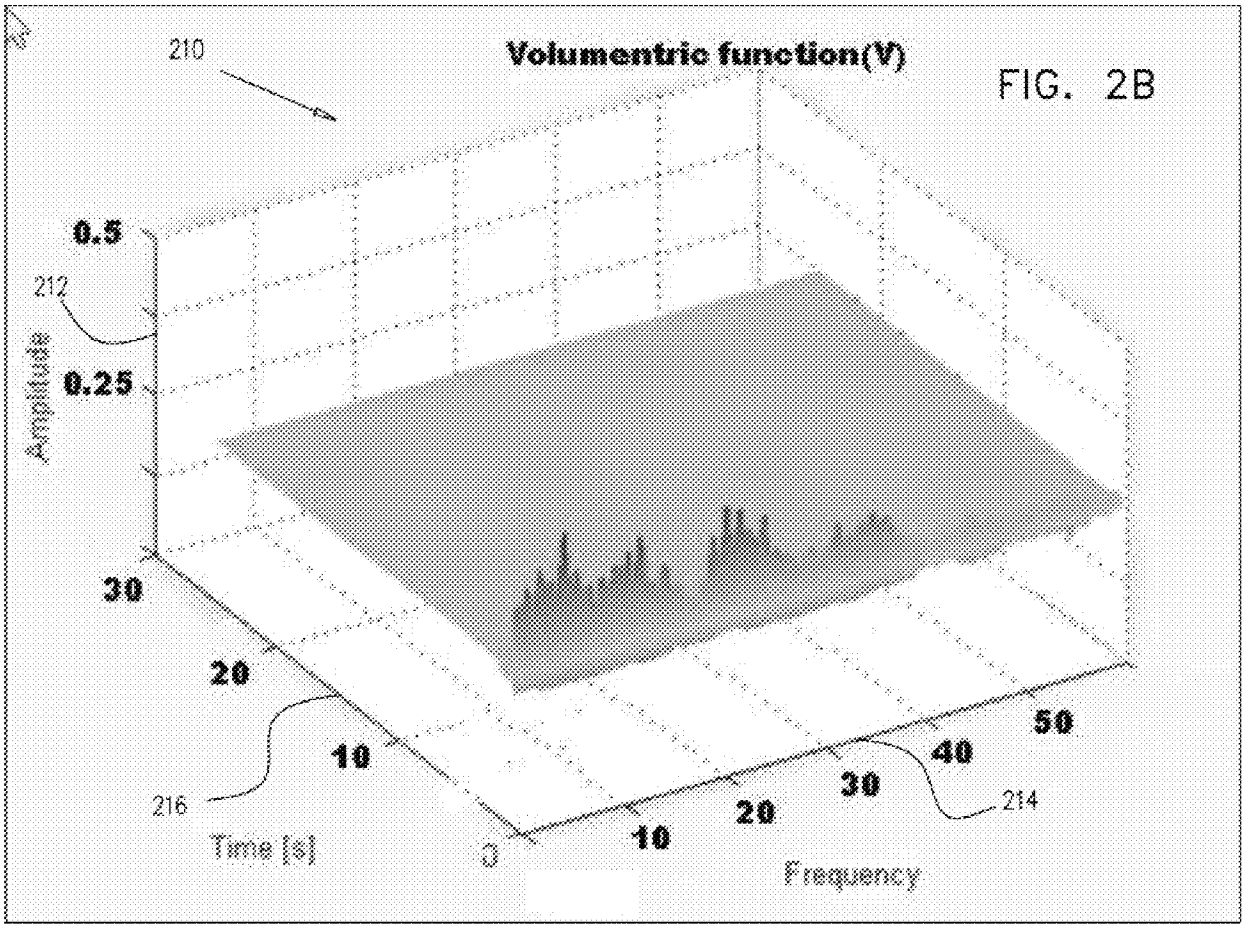
FIGS. 2B, 2C and 2D are alternative simplified graphic representations of a plurality of acoustic event indications received and processed by the glass breakage detection system of FIG. 1.
Figure 2C:
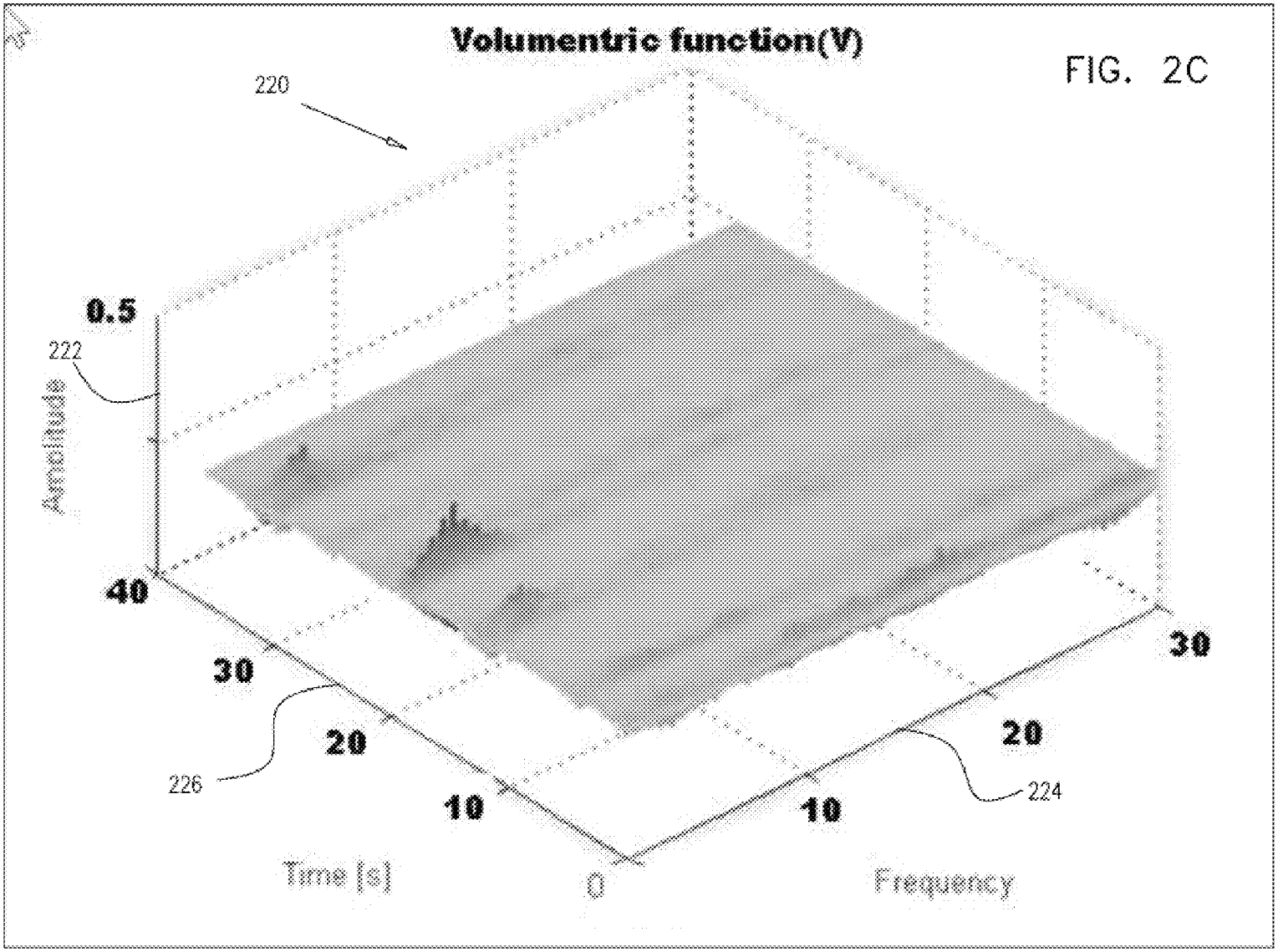
Figure 2D:
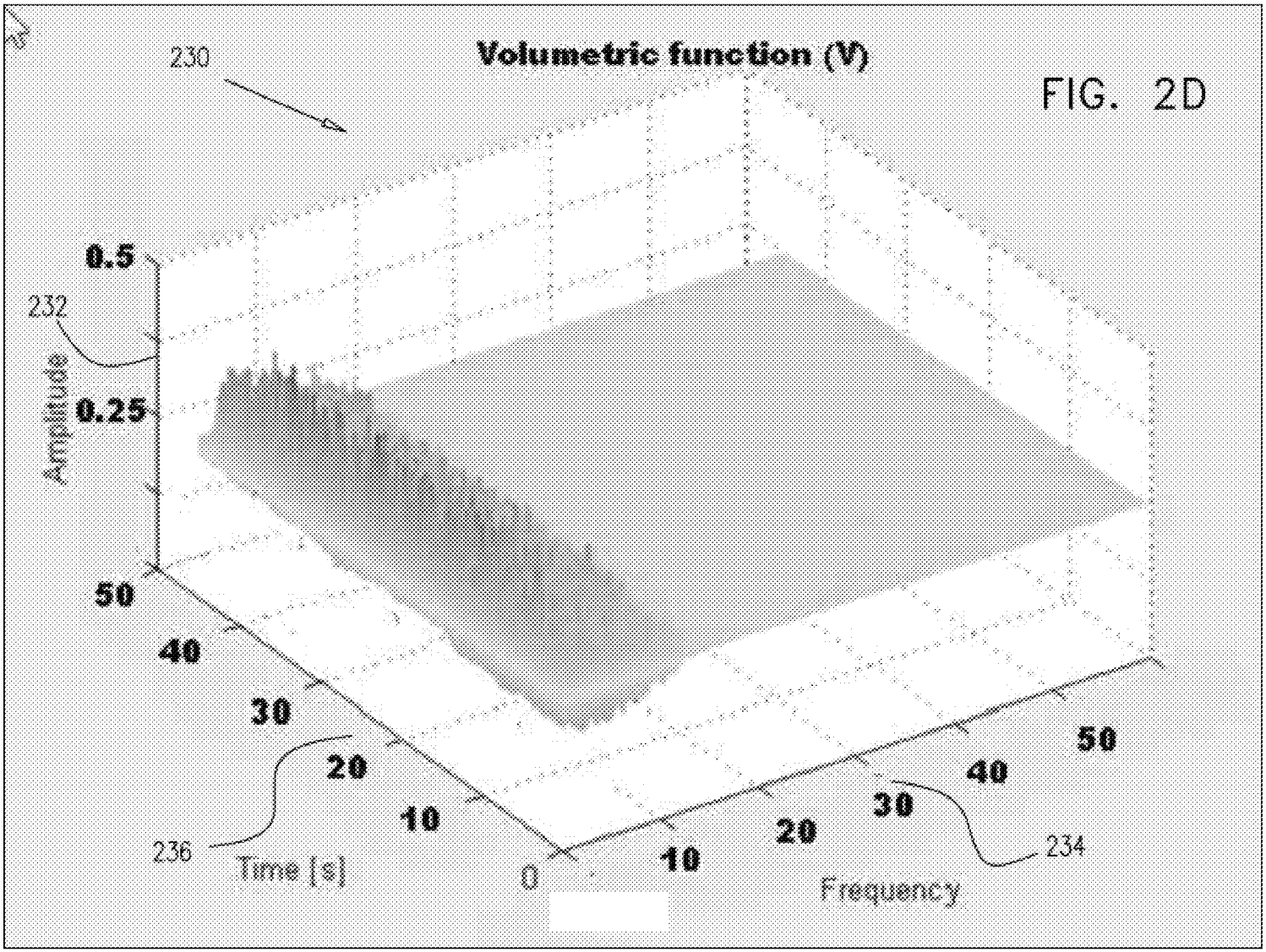

Reference is now made to FIGS. 2B, 2C and 2D, which are alternative simplified graphic representations of a plurality of acoustic event indications received and processed by the glass breakage detection system of FIG. 1.

Turning to FIG. 2B, there is shown a graph 210 which is representative of a single knock on a glass pane. Each acoustic event indication of the plurality of acoustic event indications received by event indication receiving functionality 104 of system 100 is represented on graph 210 and preferably includes:

an amplitude of a sound wave associated with the acoustic event indication plotted on axis 212 of graph 210;

a frequency of a sound wave associated with the acoustic event indication plotted on axis 214 of graph 210; and a point in time at which the acoustic event indication occurred plotted on axis 216 of graph 210.

As clearly shown in FIG. 2B, graph 210 clearly represents a relatively ordered acoustic event which occurred over a brief period of time, wherein the frequencies of the sounds generated are within a well defined frequency range. These characteristics are typical of a single knock on a glass pane, which did not result in breakage of the glass pane.

Turning now to FIG. 2C, there is shown a graph 220 which is representative of multiple knocks on a glass pane. Each acoustic event indication of the plurality of acoustic event indications received by event indication receiving functionality 104 of system 100 is represented on graph 220 and preferably includes:

an amplitude of a sound wave associated with the acoustic event indication plotted on axis 222 of graph 220;

a frequency of a sound wave associated with the acoustic event indication plotted on axis 224 of graph 220; and a point in time at which the acoustic event indication occurred plotted on axis 226 of graph 220.

As clearly shown in FIG. 2C, graph 220 clearly represents a multiplicity of relatively ordered acoustic events which occurred consecutively over a period of time, wherein the frequencies of the sounds generated are within a well defined frequency range. These characteristics are typical of multiple knocks on a glass pane, which did not result in breakage of the glass pane.

Turning now to FIG. 2D, there is shown a graph 230 which is representative of a single knock on a glass pane. Each acoustic event indication of the plurality of acoustic event indications received by event indication receiving functionality 104 of system 100 is represented on graph 230 and preferably includes:

an amplitude of a sound wave associated with the acoustic event indication plotted on axis 232 of graph 230;

a frequency of a sound wave associated with the acoustic event indication plotted on axis 234 of graph 230; and a point in time at which the acoustic event indication occurred plotted on axis 236 of graph 230.

As clearly shown in FIG. 2D, graph 230 clearly represents a relatively ordered acoustic event which is continuous over a period of time, wherein the frequencies of the sounds generated are within a well defined frequency range. These characteristics are typical of a continuous monotonous acoustic event, such as the operation of a vacuum cleaner or other motorized appliances.

Figure 3:
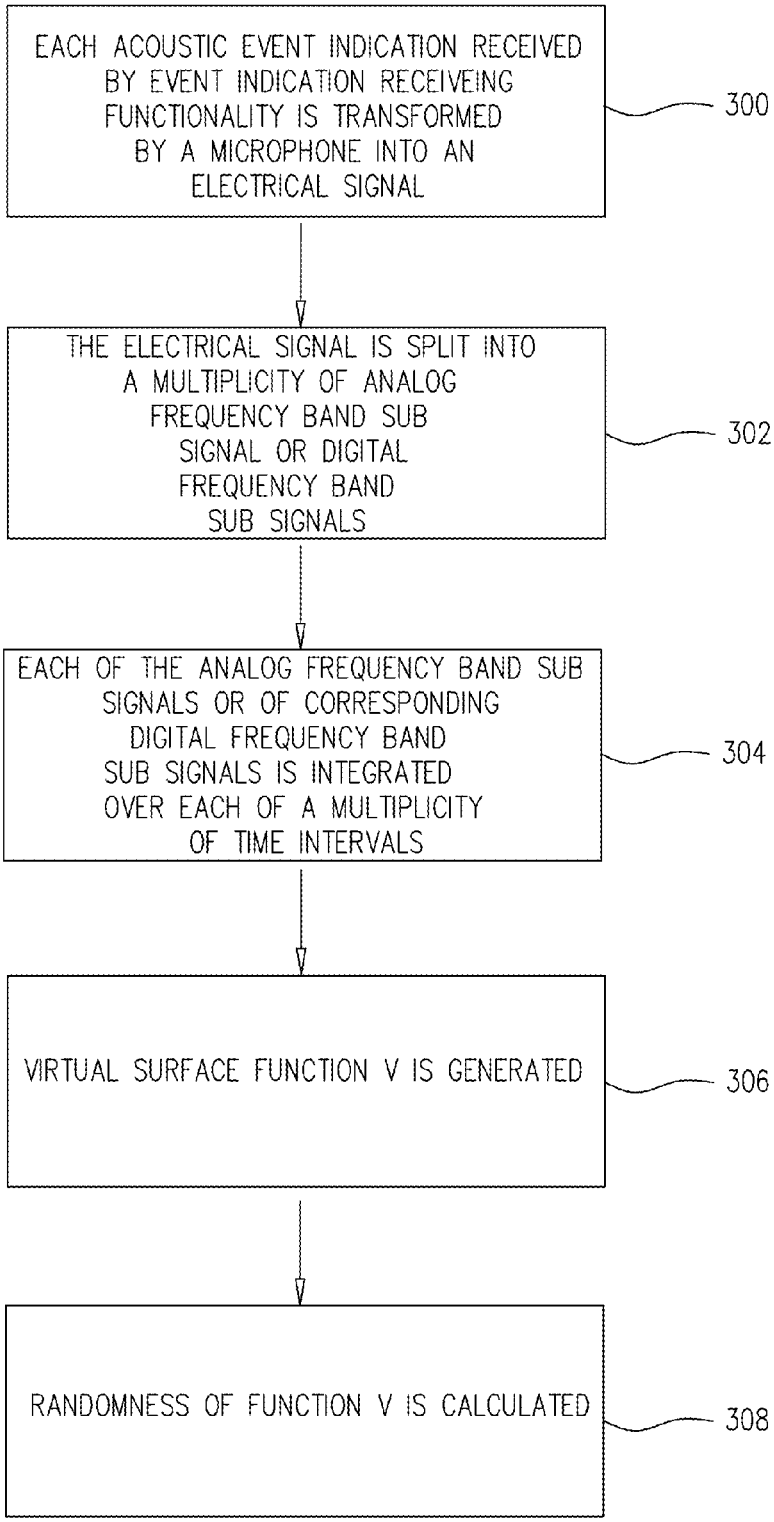
FIG. 3 is a simplified flowchart of part of the operation of the glass breakage detection system of FIG. 1.

Reference is now made to FIG. 3, which is a simplified flowchart of part of the operation of the glass breakage detection system of FIG. 1. As shown in FIG. 3, to ascertain whether the plurality of acoustic event indications represented on graph 200 (FIG. 2A) together indicate an acoustic event of a random nature, random acoustic event analyzing functionality 102 preferably generates a volumetric function V from the plurality of acoustic event indications which are represented on graph 200.

Initially, each acoustic event indication received by event indication receiving functionality 104 is transformed by a microphone into an electrical signal (300) which is then preferably split into a multiplicity of analog frequency band sub signals (Sb1, Sb2 . . . Sbk) (302). More preferably, frequency band sub signals (Sb1, Sb2 . . . Sbk) are then transformed to a corresponding multiplicity of digital frequency band sub signals (Db1, Db2 . . . Dbk).

A glass breakage event typically has a duration of 1.5 seconds, which duration can be split into a multiplicity of time intervals ($\Delta\tau(t1)$, $\Delta\tau(t2)$ . . . $\Delta\tau(ti)$). Each signal of the multiplicity of analog frequency band sub signals (Sb1, Sb2 . . . Sbk) or of corresponding multiplicity of digital frequency band sub signals (Db1, Db2 . . . Dbk) is preferably integrated over each of the multiplicity of time intervals ($\Delta\tau(t1)$, $\Delta\tau(t2)$ . . . $\Delta\tau(ti)$) (304), thereby resulting in a multiplicity of sequences of integrated values, which can be represented in a matrix, for example:

| | | | |
|---|---|---|---|
| V11 (Sb1, Δτ(t1)); | V12 (Sb1, Δτ(t2)); | . . . V1i (Sb1, Δτ(ti)); | ....; |
| V21 (Sb2, Δτ(t1)); | V22 (Sb2, Δτ(t2)); | . . . V2i (Sb2, Δτ(ti)); | ....; |
| .....; | .....; | . . . .....; | ....; |
| Vk1 (Sbk, Δτ(t1)); | Vk2 (Sbk, Δτ(t2)); | . . . Vki (Sbk, Δτ(ti)); | ....; |
| .....; | .....; | . . . .....; | |

wherein, Vki is an integrated value of analog signal Sbk or digital signal Dbk during time interval Δτ (ti). This matrix of values represents a virtual surface function V (306) which represents a volumetric image of the acoustic event.

As described hereinabove, it is appreciated that the random nature of at least part of an acoustic event typically corresponds to the random nature of sound waves corresponding to the falling of glass debris and/or glass pane cracking, and is thereby indicative of an acoustic event corresponding to the breakage of glass. To ascertain the randomness of function V calculated hereinabove (308), well known methods may be employed, such as, for example, entropy estimation of the function V.

It will be appreciated by persons skilled in the art that the present invention is not limited by what has been particularly shown and described hereinabove. Rather the scope of the present invention includes both combinations and subcombinations of the various features described hereinabove as well as modifications thereof which would occur to persons skilled in the art upon reading the foregoing description and which are not in the prior art.

The invention claimed is:

1. A method for detecting a glass breakage event, said method comprising:

responsive to receiving a plurality of acoustic event indications associated with an acoustic event, ascertaining whether said plurality of acoustic event indications together indicate a random nature of at least part of said acoustic event; and responsive to said ascertaining that said plurality of acoustic event indications together indicate a random nature of at least part of said acoustic event, ascertaining that said acoustic event corresponds to a glass breakage event;

wherein said ascertaining, whether said plurality of acoustic event indications together indicate a random nature of at least part of said acoustic event comprises transforming said plurality of acoustic event indications into a virtual surface function representing a frequency distribution of said acoustic event and ascertaining a randomness of said virtual surface function representing said frequency distribution of said acoustic event.

2. A method for detecting a glass breakage event according to claim 1 and wherein each acoustic event indication of said plurality of acoustic event indications comprises at least:

an amplitude of a sound wave associated with said acoustic event indication;

a frequency of a sound wave associated with said acoustic event indication; and a point in time at which said acoustic event indication occurred.

3. A method for detecting a glass breakage event according to claim 1 and wherein each of said plurality of acoustic event indications is associated with one of:

a sound wave corresponding to the smashing of a glass pane;

a sound wave corresponding to the cracking of a glass pane; and a sound wave corresponding to the falling of glass debris.

4. A method for detecting a glass breakage event according to claim 3 and wherein said random nature of at least part of said acoustic event corresponds to a random nature of at least one of said sound wave corresponding to said falling of glass debris and said sound wave corresponding to the cracking of a glass pane.

5. A glass breakage detection system, said system comprising:

random acoustic event analyzing functionality operable for:

ascertaining, responsive to receiving a plurality of acoustic event indications associated with an acoustic event, whether said plurality of acoustic event indications together indicate a random nature of at least part of said acoustic event; and responsive to said ascertaining that said plurality of acoustic event indications together indicate a random nature of at least part of said acoustic event, ascertaining that said acoustic event corresponds to a glass breakage event;

wherein said ascertaining whether said plurality of acoustic event indications together indicate a random nature of at least part of said acoustic event comprises transforming said plurality of acoustic event indications into a virtual surface function representing a frequency distribution of said acoustic event and ascertaining a randomness of said virtual surface function representing said frequency distribution of said acoustic event.

6. A glass breakage detection system according to claim 5 and also comprising acoustic event indication receiving functionality operable for receiving said plurality of acoustic event indications associated with said acoustic event.

7. A glass breakage detection system according to claim 5 and wherein each acoustic event indication of said plurality of acoustic event indications comprises at least:

an amplitude of a sound wave associated with said acoustic event indication;

a frequency of a sound wave associated with said acoustic event indication; and a point in time at which said acoustic event indication occurred.

8. A glass breakage detection system according to claim 5 and wherein each of said plurality of acoustic event indications is associated with one of:

a sound wave corresponding to the smashing of a glass pane;

a sound wave corresponding to the cracking of a glass pane; and a sound wave corresponding to the falling of glass debris.

9. A glass breakage detection system according to claim 8 and wherein said random nature of at least part of said acoustic event corresponds to a random nature of at least one of said sound wave corresponding to said falling of glass debris and said sound wave corresponding to the cracking of a glass pane.

* * * * *